United States Patent [19]

Sweeton et al.

[11] 4,006,726

[45] Feb. 8, 1977

[54] OSCILLATOR TYPE BALL DEFLECTOR

[75] Inventors: Gerard F. Sweeton, Skillman, N.J.; Howard Head, Baltimore, Md.

[73] Assignee: Prince Manufacturing, Inc., Princeton, N.J.

[22] Filed: Dec. 4, 1975

[21] Appl. No.: 637,618

Related U.S. Application Data

[63] Continuation of Ser. No. 418,100, Nov. 21, 1973, abandoned.

[52] U.S. Cl. ..... 124/81

[51] Int. Cl.[2] ..... F41D 11/00

[58] Field of Search ..... 124/81; 273/26 D, 29 A

[56] References Cited

UNITED STATES PATENTS

| | | | |
|---|---|---|---|
| 2,182,369 | 12/1939 | Barron | 124/81 |
| 3,288,127 | 11/1966 | Bullock | 124/81 X |
| 3,308,802 | 3/1967 | Applegate | 124/81 X |

*Primary Examiner*—Richard C. Pinkham
*Assistant Examiner*—William R. Browne
*Attorney, Agent, or Firm*—Sperry and Zoda

[57] ABSTRACT

A ball projecting machine is provided with ball deflector for controlling the direction in which balls are projected from the machine. The deflector is movable from one position to another and is actuated by a ball being projected so that the direction of travel of successive balls discharged from the machine may be varied. The deflector has a mechanism for holding the deflector in a predetermined position until engaged by a discharged ball.

13 Claims, 3 Drawing Figures

OSCILLATOR TYPE BALL DEFLECTOR

This application is a continuation of U.S. Ser. No. 418,100 filed Nov. 21, 1973, now abandoned.

FIELD OF INVENTION

Numerous devices have been developed for projecting balls, such as tennis balls, or the like, to a person wishing to receive or return the balls for practice purposes as exemplified by the constructions shown in U.S. Pat. Nos. 1,198,300; 3,306,613; and 3,584,614. Some devices of this type have been provided with means for varying the direction in which balls are projected from the machine as exemplified by the U.S. Pat. Nos. 3,277,879; 3,568,653 3,602,208 and 3,659,576. However, all such devices have been relatively complicated and expensive to produce and use and have generally been pre-programmed by mechanical or electrical means or have been pre-set to direct the balls in the same direction or manner each time they are discharged from the machine.

In accordance with the present invention simple and inexpensive devices are provided which may be applied to existing ball projecting machines to alter or vary the direction in which successive balls are discharged from the machine. In the preferred form of the invention herein shown and described the device is provided with ball directing means which are actuated by balls discharged from the machine so as to assume a different position when successive balls are discharged to cause such successive balls to travel in different directions. Thus, for example, an oscillating deflector may be mounted for pivoted movement back and forth upon engagement of a ball therewith so that the balls will be alternately directed to opposite sides of a court or playing area.

THE DRAWINGS

Figure 1:
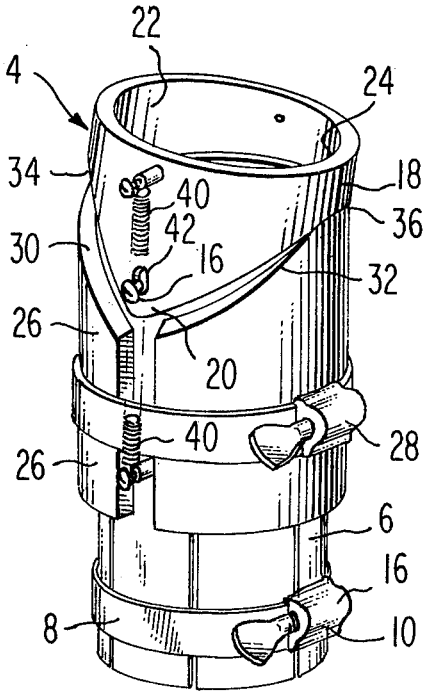
FIG. 1 is a perspective view of a typical embodiment of the present invention adapted to be applied to the barrel of a ball projecting machine.
Figure 2:
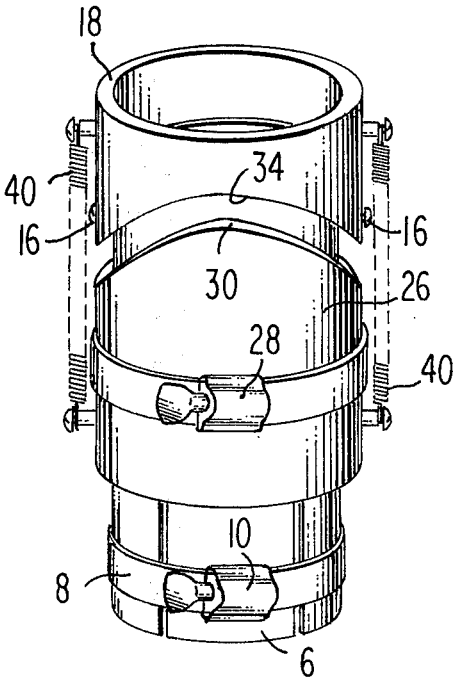
FIG. 2 is a side elevation of the device illustrated in in FIG. 1.

In that form of the invention chosen for purposes of illustration in the drawing, a ball throwing machine having a barrel 2 is provided with ball directing means indicated generally at 4 and has a sleeve 6 adapted to fit over the discharge end of the barrel 2 so as to be secured in place thereon by a retaining band 8 and tightening means 10 or other suitable means.

Figure 3:
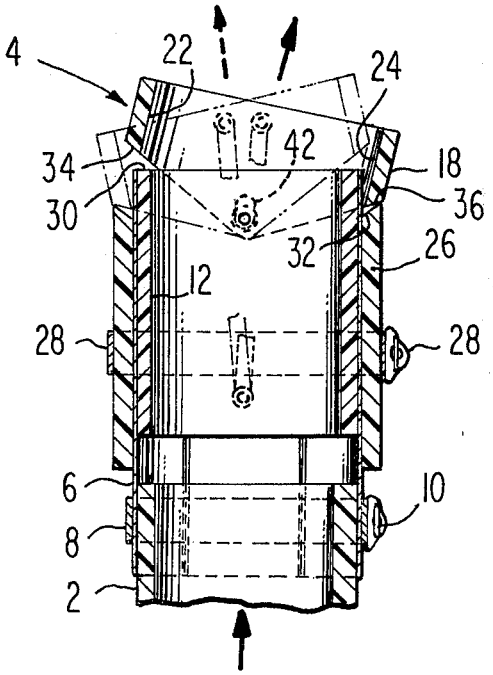
FIG. 3 is a longitudinal sectional view through a portion of the barrel of a ball throwing machine having the device of FIG. 1 applied thereto.

The sleeve 6 has an inner ball guiding tube 12 carried thereby and aligned with the barrel 2 for receiving and directing the balls toward a movable member 18 which is pivotally mounted at 16 near the outer end of the sleeve 6 and functions as a ball deflecting device. The deflecting device shown is in the form of a generally tubular element of somewhat larger internal diameter than the sleeve 6 and guiding tube 12. The tubular element 18 has side portions 20 through which screws or other means forming the pivots 16 extend to permit it to oscillate back and forth from the full line position to the dotted line position of FIG. 3. The diameter and length of the tubular element 18 are chosen so as to cause one or the other of the opposed inner deflecting surfaces 22 and 24 of the tubular element to move into a position wherein it will be contacted by a ball discharged from the barrel 2 when said element is in a tilted position.

Stop means 26 in the form of a split collar surround the sleeve 6 and are adjustably secured in place by a retaining band and clamping means 28. The outer extremity of the stop means 26 is formed with oppositely located limiting surfaces 30 and 32, which are spaced from the adjacent edges or shoulders 34 and 36 of the tubular element 18 of the deflecting means 14. The stop means is adjustably movable to a selected position by loosening and tightening the clamping means 28 so that the collar 26 may be moved toward and away from the tiltable element 18 of the deflecting means to vary the spacing of the surfaces 30 and 32 from the adjacent shoulders 34 and 36 of the element 18. In this way the angle of inclination of the tubular element as it rocks back and forth on its pivot 16 can be altered and controlled to vary the limiting position of the oppositely facing inner deflecting surfaces 22 and 24 of the tubular element 18. The direction of flight of the balls discharged from the barrel 2 of the ball projecting machine can therefore be controlled and changed as desired for practice of the game of tennis, ping-pong or the like.

The tiltable deflecting member is yieldably or releasably held in that position to which it is moved by a ball passing therethrough and for this purpose springs 40 are preferably connected to the deflecting member 18 and to the collar 26 at points thereon spaced longitudinally at opposite sides of the pivot 16. The springs therefore serve as a toggle means yieldable to permit the tubular element 18 to oscillate back and forth within the limits permitted by stop means 26 and holds the element in that position to which it is moved until another ball is discharged from the barrel 2. The opening 42 in the tubular element 18 through which the pivot pin 16 projects is preferably elongated to permit limited movement of the element in a direction parallel to the barrel 2 to reduce the tendency of the tubular element to "bounce back" when it is rapidly tilted by a ball traveling at high speed from the barrel into contact with one or the other of the opposed inwardly facing deflecting survaces 22 and 24 of the tubular element. However, other means such as magnetic elements, spring pressed catches of the like may be provided for releasably holding the deflecting means in that position to which it is moved.

The construction thus provided is adapted to be applied to the barrel of any suitable or preferred type of ball projecting machine and can be secured thereon by the retaining band 8 and clamping means 10. Thereafter, when a ball is discharged from the barrel 2 it will travel through the tube 12 of the ball deflecting means into contact with one or the other of the inwardly facing deflecting surface 22 or 24 of the tubular element 18. As a result, the ball will be directed to one side or the other of a playing court at an angle dependent upon the angle of inclination of the element 18 with respect to the barrel 2. At the same time the ball upon contacting the deflecting surface of the tubular element will cause said element to be tilted about its pivot 16 to an opposite position in which the opposite deflecting surface of the tubular element to be presented for deflecting a succeeding ball in the opposite direction when it is discharged from the ball throwing machine. In this manner the deflecting device is actuated by each successive ball discharged from the barrel to change the position thereof and cause the next ball discharged from the machine to travel in a different direction from that of the preceding ball.

The ball deflecting device may be provided with means for reducing or controlling the spin applied to the balls upon discharge thereof and for this purpose one or both of the deflecting surfaces 22 and 24 may be either polished or roughened or provided with antifriction means such as rollers or ball bearings operable to increase or decrease the drag upon balls contacting the same. In this way the spin applied to a ball projected from the barrel 2 may be controlled as desired.

While the ball directing means embodied in the form of the invention shown in the drawings and described above is in the form of an oscillating ball deflecting device, other ball actuated means may be provided for varying the direction in which successive balls are projected. Thus for example, means engagable by the balls being projected by the machine may serve to index or change the position of the ball deflecting means, barrel or other element of the assembly in a desired or random manner to vary the direction in which successive balls are discharged from the machine. In view thereof, it should be understood that the particular embodiment of the invention shown in the drawings is intended to be illustrative only and not intended to limit the scope of the invention.

We claim:

1. For use with a ball projecting device, a ball directing means comprising a deflecting means adapted to be mounted on the device in a position to be engaged by successively discharged balls, said deflecting means being pivotally mounted and having a plurality of alternatively engageable positions, said deflecting means being responsive to engagement with successively discharged balls to assume one of the plurality of ball engaging positions, and a releasable holding means for holding said deflecting means in a predetermined position until engaged by a discharged ball.

2. The ball directing means as defined in claim 1 wherein said deflecting means is a pivotally mounted tubular element.

3. The ball directing means as defined in claim 2 further comprising a barrel for guiding discharged balls through the ball directing means.

4. The ball directing means as defined in claim 3 wherein said tubular element has an internal diameter exceeding the inside diameter of said barrel.

5. The ball directing means as defined in claim 4 wherein said pivot means is mounted on said barrel and said tubular element is mounted on said pivot means with play along the direction of axis of said barrel.

6. The ball directing means as defined in claim 5 further comprising stop means mounted adjacent said tubular element to limit movement thereof about said pivot means.

7. The ball directing means as defined in claim 6 wherein said stop means is adjustable to vary movement limitations of said tubular element about said pivot means.

8. For use with a ball projecting machine, a means for varying the direction of travel of discharged balls comprising:

a. a barrel through which balls are discharged; and b. a means for varying the direction of travel of discharged balls comprising:

1. a tubular deflecting member pivotally mounted on said barrel adjacent the end thereof in a position to be engaged by discharged balls, said deflecting member being movable to successively alternate positions by successively discharged balls; and 2. a pivot means having said tubular deflecting member pivotally secured thereto.

9. The means for varying the direction of travel of discharged balls as defined in claim 8 wherein said tubular deflecting member has an internal diameter exceeding the diameter of said barrel and means are provided for yieldably holding said element in that position to which it is moved by a ball.

10. The means for varying the direction of travel of discharged balls as defined in claim 8 wherein said tubular deflecting member is loosely mounted on said pivot means for limited movement in a direction parallel to said barrel and spring means yieldably urging said member into contact with said pivot means.

11. The means for varying the direction of travel of discharged balls as defined in claim 8 wherein stop means are mounted adjacent said tubular deflecting member to limit tilting thereof about said pivot means and establish alternative positions to which said tubular deflecting member is movable about said pivot means.

12. The means for varying the direction of travel of discharged balls as defined in claim 8 wherein said stop means are adjustable to different positions to vary the angle to which said tubular deflecting member is tilted with respect to said barrel.

13. The means for varying the direction of travel of discharged balls as defined in claim 8 wherein said stop means is movable longitudinally with respect to said barrel toward and away from said tubular deflecting member to vary the angle to which said tubular deflecting member is tilted about said pivot means.

* * * * *